US009441891B2

(12) United States Patent
Tsou et al.

(10) Patent No.: US 9,441,891 B2
(45) Date of Patent: Sep. 13, 2016

(54) LED LIGHTING DEVICE WITH IMPROVED HEAT SINK

(71) Applicant: SPINLUX TECHNOLOGY CO., New Taipei (TW)

(72) Inventors: Shih-En Tsou, New Taipei (TW); Shyh-Shiun Sheu, New Taipei (TW)

(73) Assignee: SPINLUX TECHNOLOGY CO., New Taipei (TW)

( * ) Notice: Subject to any disclaimer, the term of this patent is extended or adjusted under 35 U.S.C. 154(b) by 455 days.

(21) Appl. No.: 14/073,897

(22) Filed: Nov. 7, 2013

(65) Prior Publication Data

US 2014/0369054 A1 Dec. 18, 2014

(30) Foreign Application Priority Data

Jun. 18, 2013 (TW) ..... 102121633 A

(51) Int. Cl.

| | |
|---|---|
| ***F28F 3/06*** | (2006.01) |
| ***F21V 29/00*** | (2015.01) |
| ***F21V 29/71*** | (2015.01) |
| ***F21V 29/76*** | (2015.01) |
| *F21Y 101/02* | (2006.01) |
| *F21Y 105/00* | (2016.01) |

(52) U.S. Cl.

CPC ..... *F28F 3/06* (2013.01); *F21V 29/717* (2015.01); *F21V 29/763* (2015.01); *F21V 29/767* (2015.01); *F21Y 2101/02* (2013.01); *F21Y 2105/001* (2013.01); *F28F 2215/10* (2013.01)

(58) Field of Classification Search

CPC ..... F21V 29/004; F21V 29/10; F21V 29/20; F21V 29/2212; F21V 29/50; F21V 29/502; F21V 29/507; F21V 29/70; F21V 29/71; F21V 29/713; F21V 29/717; F21V 29/74; F21V 29/76; F21V 29/763; F21V 29/767; F28F 3/00; F28F 3/02; F28F 3/06; F28F 3/08; F28F 3/083; F28F 3/086; F28F 2215/10

See application file for complete search history.

(56) References Cited

U.S. PATENT DOCUMENTS

| | | | | |
|---|---|---|---|---|
| 5,818,694 | A * | 10/1998 | Daikoku | F28F 3/02 165/80.3 |
| 5,819,407 | A * | 10/1998 | Terada | B21K 25/00 257/E23.103 |
| 6,279,648 | B1 * | 8/2001 | Diels | F28F 3/02 165/185 |
| 7,762,315 | B2 * | 7/2010 | Shen | H01L 23/3672 165/80.3 |
| 2005/0006061 | A1 * | 1/2005 | Quisenberry | F28D 15/0233 165/104.33 |
| 2005/0274120 | A1 * | 12/2005 | Quisenberry | F28D 15/0233 62/3.7 |
| 2007/0074850 | A1 * | 4/2007 | Peschl | F28F 3/02 165/80.3 |
| 2007/0273290 | A1 * | 11/2007 | Ashdown | F21V 29/004 315/113 |

(Continued)

*Primary Examiner* — Renee Chavez
*Assistant Examiner* — Colin Cattanach
(74) *Attorney, Agent, or Firm* — Chun-Ming Shih; HDLS IPR Services

(57) ABSTRACT

An LED lighting device includes an LED light engine and a heat sink including a heat dissipation structure. The heat dissipation structure includes: a plurality of heat conductive rod rows including a plurality of vertical heat conductive rods; a plurality of horizontal heat conductive rods including a plurality of surfaces and attached onto one end of the vertical heat conductive rods; another end of the vertical heat conductive rods vertically attached to a back side of the LED light engine; and a plurality of fin modules attached to any one of the surfaces of the horizontal heat conductive rods. Accordingly, the heat dissipation area is increased and the heat sink is separated from the LED light engine such that heat dose not accumulate thereon and the shortcoming of airflow on the heat sink can be overcome with improvements.

20 Claims, 7 Drawing Sheets

(56) References Cited

U.S. PATENT DOCUMENTS

2010/0008094 A1* 1/2010 Shuai ..... F21V 29/004 362/373
2010/0013367 A1* 1/2010 Yang ..... F21V 29/004 313/46
2010/0096993 A1* 4/2010 Ashdown ..... F21V 29/004 315/113
2011/0103060 A1* 5/2011 Wang ..... F21V 29/004 362/249.02
2012/0154772 A1* 6/2012 Laufer ..... G02B 7/1815 355/45
2012/0275152 A1* 11/2012 Payne ..... F21V 29/74 362/249.01
2013/0100678 A1* 4/2013 Baxter ..... F21V 13/02 362/311.06
2013/0269920 A1* 10/2013 Taketomi ..... F28F 3/02 165/185
2014/0078737 A1* 3/2014 Lin ..... F21V 29/2206 362/249.02
2014/0168895 A1* 6/2014 Liu ..... H01L 23/3672 361/697
2014/0184050 A1* 7/2014 Mizuta ..... F21V 29/717 313/35

* cited by examiner

LED LIGHTING DEVICE WITH IMPROVED HEAT SINK

BACKGROUND OF THE INVENTION

1. Field of the Invention

The present invention is related to a heat sink, in particular, to an LED lighting device with an improved heat sink.

2. Description of Related Art

During the operation of LED, approximately 80% of the total energy is transmitted to the environment in the form of waste heat. However, the operation in high temperature can have significant effects on electronic components such as lifetime, product reliability and light decay.

A known LED light engine comprises a circuit board and a plurality of LED units electrically connected on the circuit board. With the heat sink provided on the LED light engine, the heat generated by the LED units can be dissipated via the heat sink such that the lifetime of the LED units can be extended, the reliability of the LED units can be increased and the light decay of the LED units can be reduced.

Furthermore, the aluminum extrusion or fin type of heat sinks only allows the air to enter at the direction parallel to the fins. When the heat sink is overly large, such as the surface area of the heat sink is too large or too long, the air cannot reach the center of the heat sink (i.e. the position of the heat generating unit) at all, which causes the effect of heat dissipation to be greatly reduced. To solve such problem, it is a common practice to introduce a cutting slot in the direction perpendicular to the aluminum extruded fins; however, the problem is still not being overcome completely due to the limited effects of insufficient width of the cutting slot. On the other hand, if the width of the cutting slot is too large, a large portion of the surface area of the fins for heat dissipation would be wasted, which is not only difficult in practice but also results in limited effects of heat dissipation.

In addition, the aforementioned heat sinks are only suitable for low-power LED lighting apparatus and heat sinks. For high-power LED light engines (such as 1000~5000 W) of the present time, they are clearly insufficient; in view of above, there is a need for an improved heat sink applicable to high-power LED light engines and capable of achieving heat dissipation effectively.

SUMMARY OF THE INVENTION

A first aspect of the present invention is to provide an LED lighting device with an improved heat sink, which uses a special connection method and a combination of vertical heat conductive rods with horizontal conductive rods to increase the heat dissipation area and is able to separate the heat sink from the LED light engine such that the heat does not accumulate on the LED light engine in order to significantly enhance the effect of heat dissipation. Furthermore, it is also able to use the longitudinally and laterally interacting and cross-linking of air channels and fin channels, in a manner similar to the chessboard, in order to overcome the shortcoming of air unable to reach particular locations of the heat sink (such as the center of the heat sink) with improved airflows.

A second aspect of the present invention is to provide an LED lighting device with an improved heat sink, which is capable of allowing the heat sinks to be vertically stacked on top of each other layer by layer with an increasing height in order to increase the heat dissipation capacity and to meet the demands of current LED light engines of increasingly higher powers.

Accordingly, the present invention provides a heat sink comprising a heat dissipation structure, the heat dissipation structure comprising: a plurality of heat conductive rod rows, each one of the plurality of heat conductive rod rows comprising a plurality of vertical heat conductive rods; a plurality of horizontal heat conductive rods, each one of the plurality of horizontal heat conductive rods comprising a plurality of surfaces and attached onto one end of the plurality of vertical heat conductive rods of each one of the plurality of heat conductive rod rows; and a plurality of fin modules, attached to any one of the plurality of surfaces of each one of the plurality of horizontal heat conductive rods.

The present invention further provides an LED lighting device comprising: an LED light engine; and a heat sink comprising a heat dissipation structure; the heat dissipation structure comprising: a plurality of heat conductive rod rows, each one of the plurality of heat conductive rod rows comprising a plurality of vertical heat conductive rods; a plurality of horizontal heat conductive rods, each one of the plurality of horizontal heat conductive rods comprising a plurality of surfaces and attached onto one end of the plurality of vertical heat conductive rods of each one of the plurality of heat conductive rod rows; another end of the plurality of vertical heat conductive rods of each one of the plurality of heat conductive rod rows vertically attached to a back side of the LED light engine; and a plurality of fin modules, attached to any one of the plurality of surfaces of each one of the plurality of horizontal heat conductive rods.

In comparison to the related arts, the present invention is of the following merits: the heat dissipation area is increased and the heat sink is separated from the LED light engine such that the heat does not accumulate on the LED light engine in order to significantly enhance the effect of heat dissipation as mentioned in the objective, which is also able to overcome the shortcoming of air unable to reach particular locations of the heat sink (such as the center of the heat sink) with improved airflows.

BRIEF DESCRIPTION OF DRAWING

FIG. 4 is side view of second embodiment of the LED lighting device of the present invention in;

DETAILED DESCRIPTION OF THE INVENTION

The following provides detailed description of embodiments of the present invention along with the accompanied drawings. It can, however, be understood that the accompanied drawings are provided for illustrative purposes only and shall not be treated as limitations to the present invention.

Figure 3:
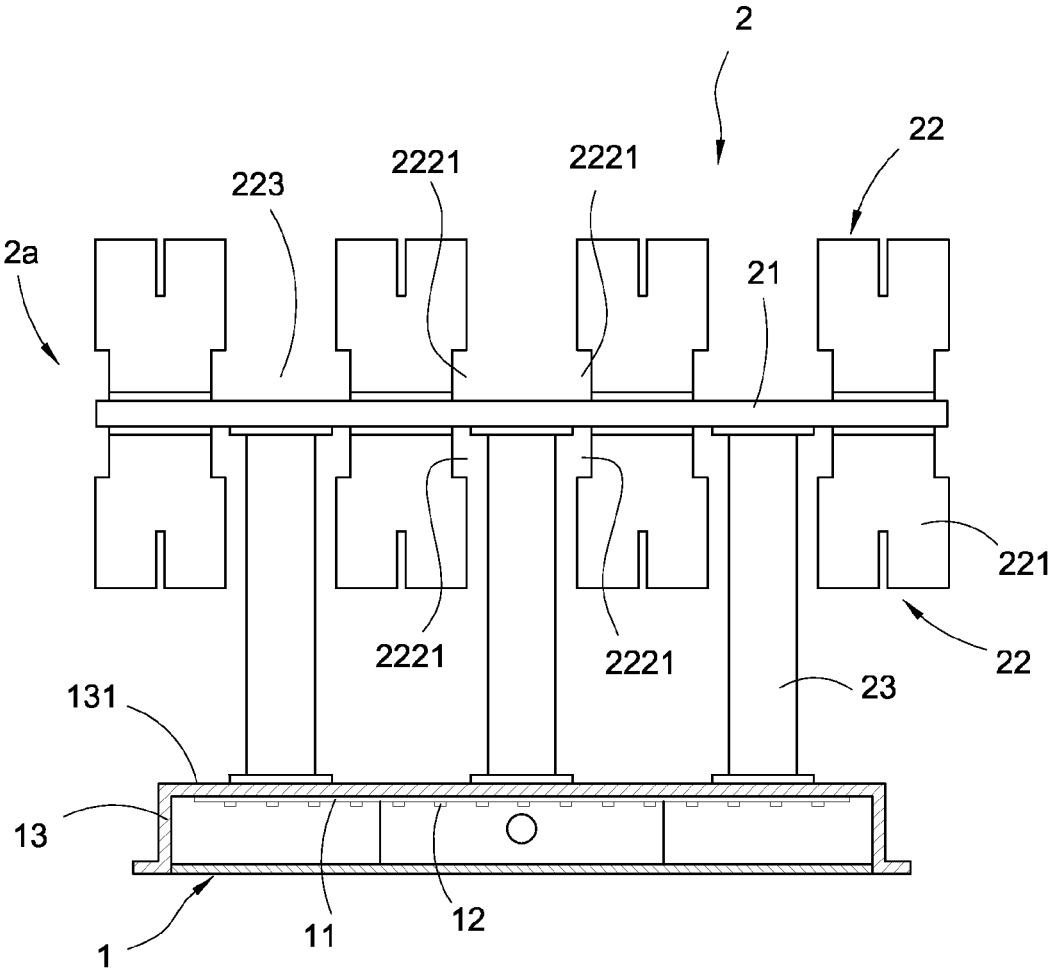
FIG. 3 is a side view of the present invention in FIG. 1.

The preset invention provides an LED lighting device with an improved heat sink. As shown in FIG. 3, the LED lighting device comprises an LED light engine 1 and a heat sink 2. The LED light engine 1 can either comprise only a circuit board 11 having a plurality of LED units 12 electrically connected thereon or further comprise a light housing 13 with the circuit board 11 arranged inside the light housing 13. That is, the circuit board 11 is flatly attached to a front side of the light housing 13 as shown in the figure. The light emitting side of the light housing 13 can be further covered with a light shell shown without reference numeral.

Figure 1:
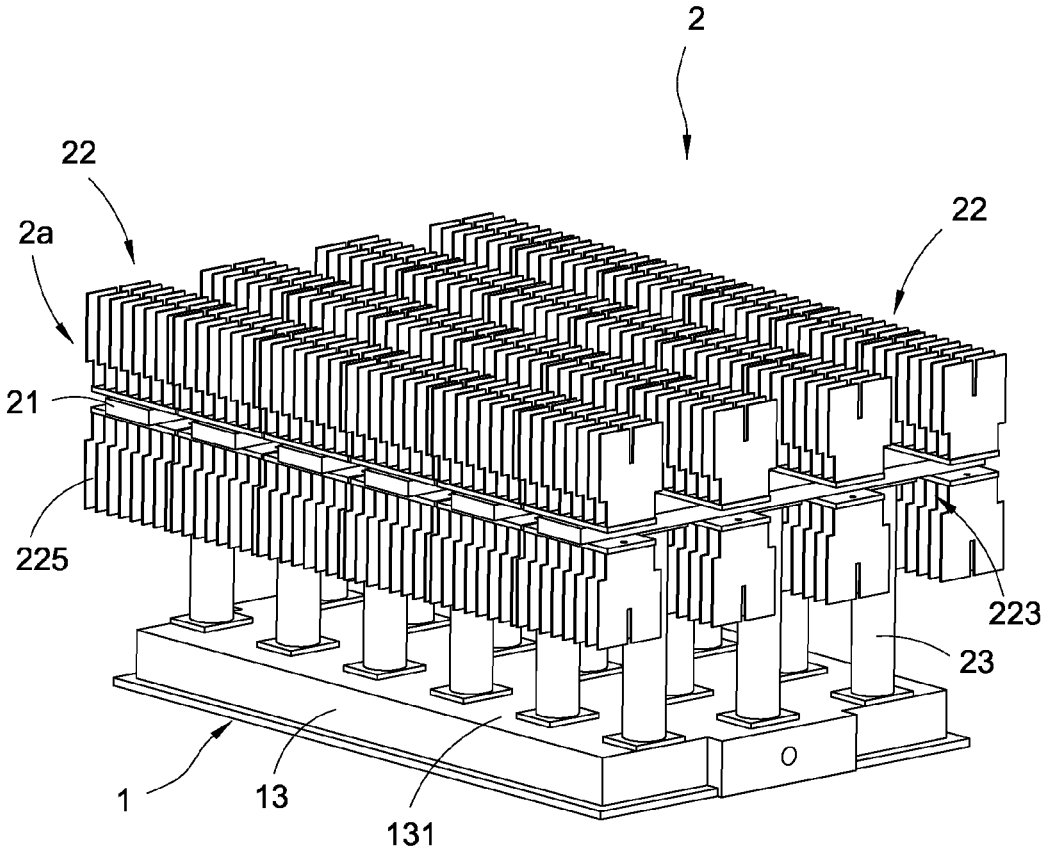
FIG. 1 is a perspective view of the first embodiment of the LED lighting device of the present invention.
Figure 2:
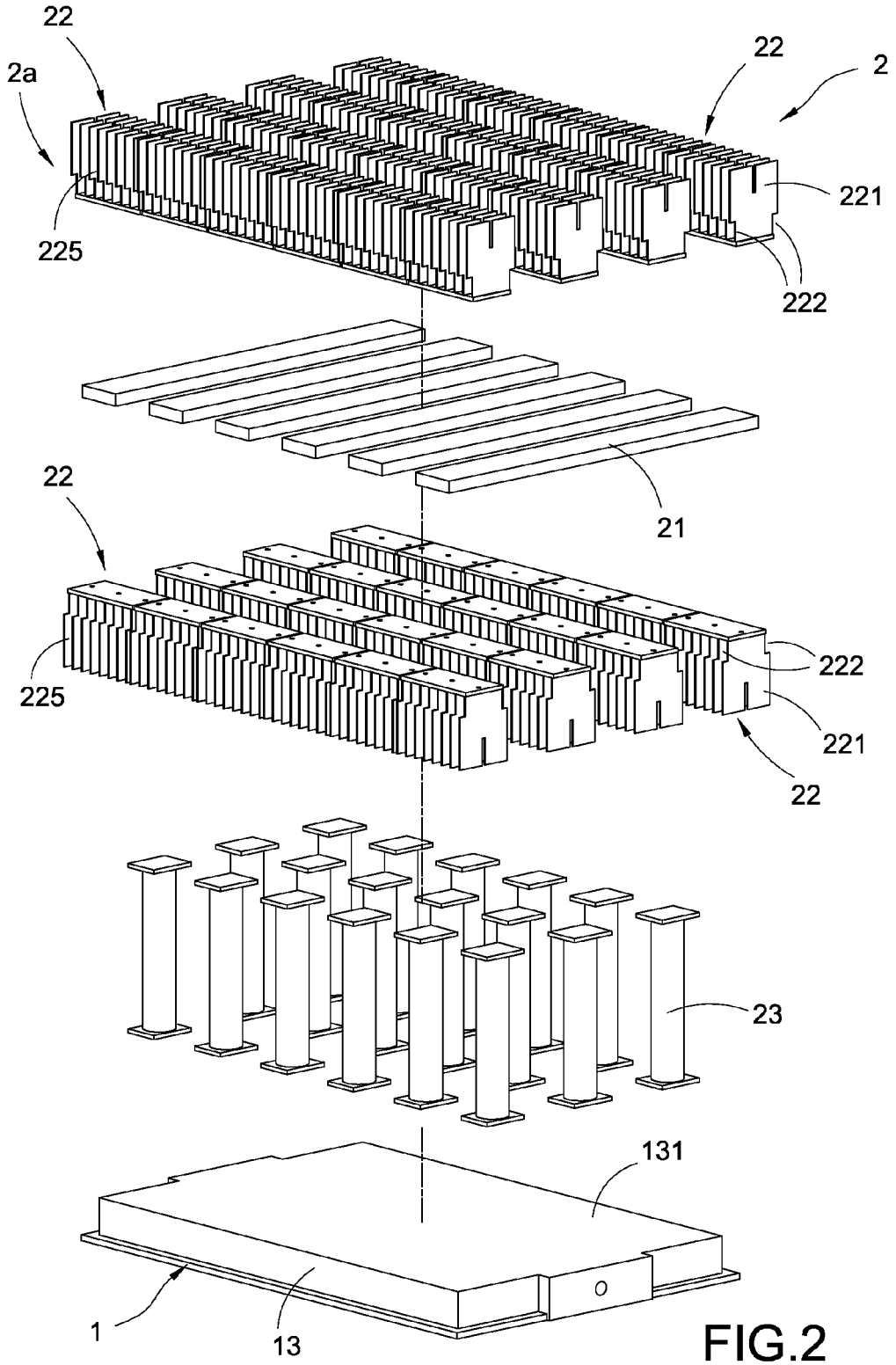
FIG. 2 is an exploded view the LED lighting device of the present invention in FIG. 1.

FIGS. 1-3 show a first embodiment of the present invention. The heat sink 2 of the LED lighting device of the present invention comprises a heat dissipation structure 2*a*. The heat dissipation structure 2*a* comprises a plurality of heat conductive rod rows, a plurality of horizontal heat conductive rods 21 and a plurality of fin modules 22; wherein each one of the plurality of heat conductive rod rows comprises a plurality of vertical heat conductive rods 23; as shown in the figures, each one of the plurality of heat conductive rod rows comprises three vertical heat conductive rods 23.

The horizontal heat conductive rods 21 can be of a flat or rectangular shape with a plurality of surfaces; the figures show the flat shape thereof. The horizontal heat conductive rods 21 comprise an upper surface and a lower surface corresponding to each other; each one of the horizontal heat conductive rods 21 is attached to an upper end of the three vertical heat conductive rods 23 of each one of the heat conductive rod rows via the lower surface thereof.

The fin modules 22 are attached to any one surface of each one of the horizontal heat conductive rods 21 and are spaced apart from each other (not shown in figure); as shown in the figures, they are connected to the upper surface and the lower surface of the horizontal heat conductive rods 21. The fin modules 22 can be attached to the horizontal heat conductive rods 21 either in intersecting and crossing links (see FIGS. 1 and 2) or in parallel; and the present invention is not limited to such ways of connections. Furthermore, the plurality of fin modules 22 are attached to the upper surface and the lower surface of the horizontal heat conductive rods 21 in a top/down manner and opposite to each other.

The fin modules 22 comprise a plurality of fins 221 spaced apart from each other. A groove 222 of any shape is provided on each one of the two opposite sides of each one of the fins 221, and an air channel 223 is formed by each one of the grooves 222 and between any four of the fin modules 22 adjacent to each other. In this embodiment, the groove 222 of each one of the fins 221 is a cut-out portion 2221; a cut-out portion 2221 is formed between the two opposite sides and the bottom of each one of the fins 221; four cut-out portions 2221 (see FIG. 3) circumference to form a rectangular opening; a plurality of openings are combined in series to form a rectangular air channel 223. In addition, a fin channel 225 (see FIG. 2) is formed between any two of the fins 221 adjacent to each other of each one of the fin modules 22 such that the air channels 223 and the fin channels 225 are fluidly connected to each other and longitudinally and laterally intersecting and crossing with each other, in a manner similar to the chessboard.

In detail, each one of the fin modules 22 is connected to the upper surface or lower surface of the horizontal heat conductive rods 21 with the bottom thereof such that a rectangular opening can be formed by each one of the grooves 222 and between any four of the fin modules 22 adjacent to each other. The plurality of fin modules 22 can be connected in series among the horizontal heat conductive rods 21 in order to allow the rectangular openings to be connected in series to form an air channel 223.

With the heat sink 2 attached to the LED light engine 1 in the present invention, the LED lighting device of the present invention can be achieved. Accordingly, the vertical heat conductive rods 23 can be directly attached to the back side of the circuit board 11 of the LED light engine 1 or can be attached to the back side 131 (as shown in FIGS. 1-3) of the light housing 13 of the LED light engine 1. In addition to that such two ways can both utilize the combination of the vertical heat conductive rods 23 with the horizontal heat conductive rods 21 in order to separate the heat sink 2 from the LED light engine 1 such that the heat does not accumulate on the LED light engine 1, such two ways both can also allow the heat generated from the LED units 12 to be transferred to the fin modules 22 via the vertical heat conductive rods 23. As shown in the figures, when the heat generated by the LED units 12 is transferred to the heat conductive light housing 13 via the circuit board 11, the heat can be further transferred to the fin modules 22 via the plurality of horizontal heat conductive rods 21 for heat dissipation. Accordingly, since the fin modules 22 are connected to the upper and lower surfaces of the horizontal heat conductive rods in a top/down manner respectively, there are great amount of fins 211 such that the heat dissipation area is increased. Furthermore, with the plurality of air channels 223 and the plurality of fin channels 225 fluidly connected with each other in intersection and cross-links, the air is able to flow freely through air channels 223 and fin channels 225 that are longitudinally and laterally intersecting and cross-linking with each other, in a manner similar to the chessboard, and without any obstacles while flowing to any parts of the heat sink 2 freely. In other words, the heat dissipation area and the effect of heat dissipation of the first embodiment of the present invention can be enhanced significantly such that it is applicable to LED light engine 1 of high working power such as 1000 W.

Figure 4:
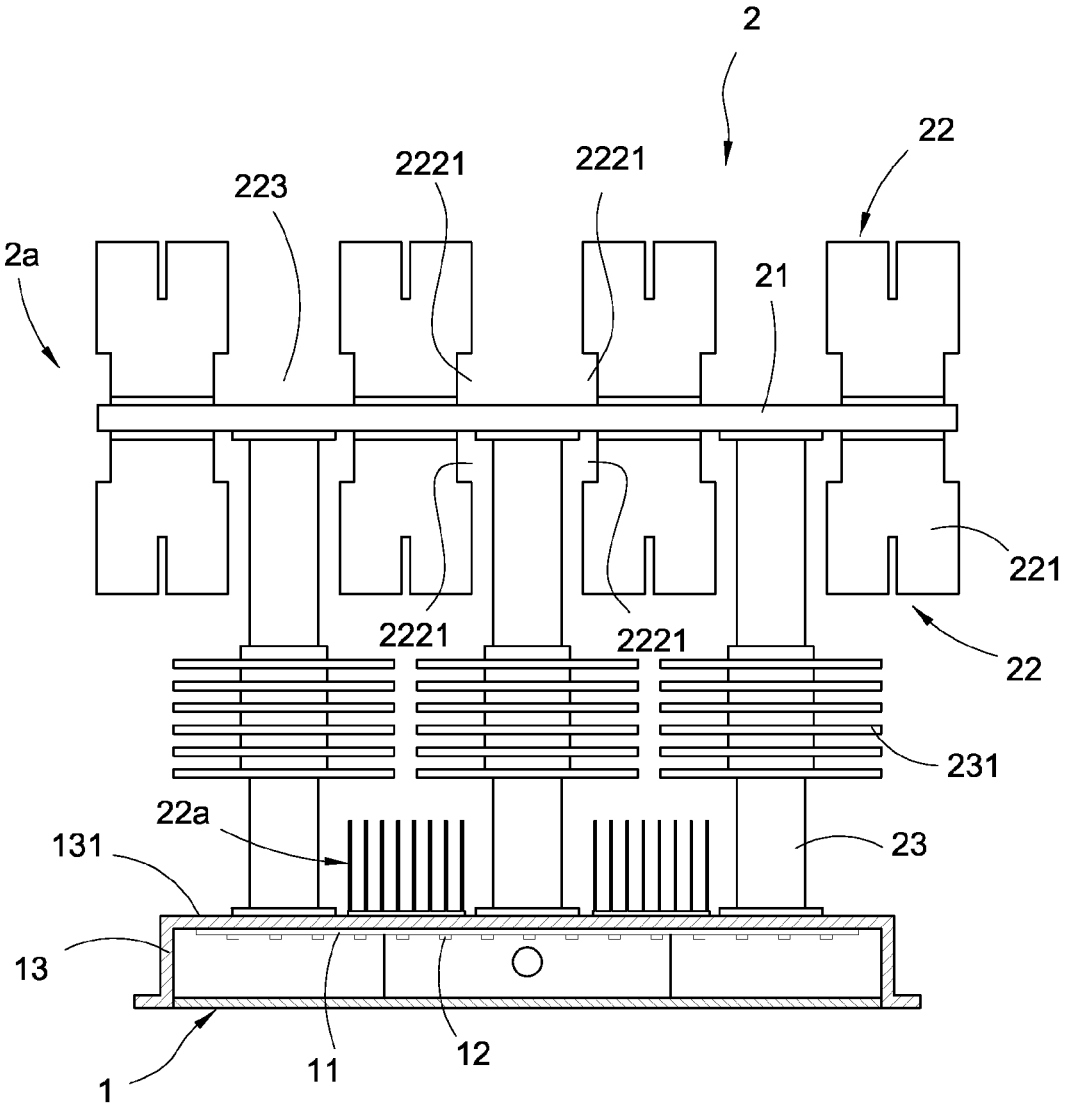

FIG. 4 shows a second embodiment of the present invention, which is generally similar to the first embodiment and with the addition of a plurality of heat dissipation fins 231 further mounted onto the vertical heat conductive rods 23 in order to increase the heat dissipation area further. A plurality of heat dissipaters can be even further provided, and the heat dissipaters can be any heat dissipation structure, which can certainly be similar to another fin modules 22*a* of the aforementioned fin modules 22 and all of the fin modules 22*a* are attached to the back side 131 of the LED light engine 1 to further enhance the effect of heat dissipation.

Figure 5:
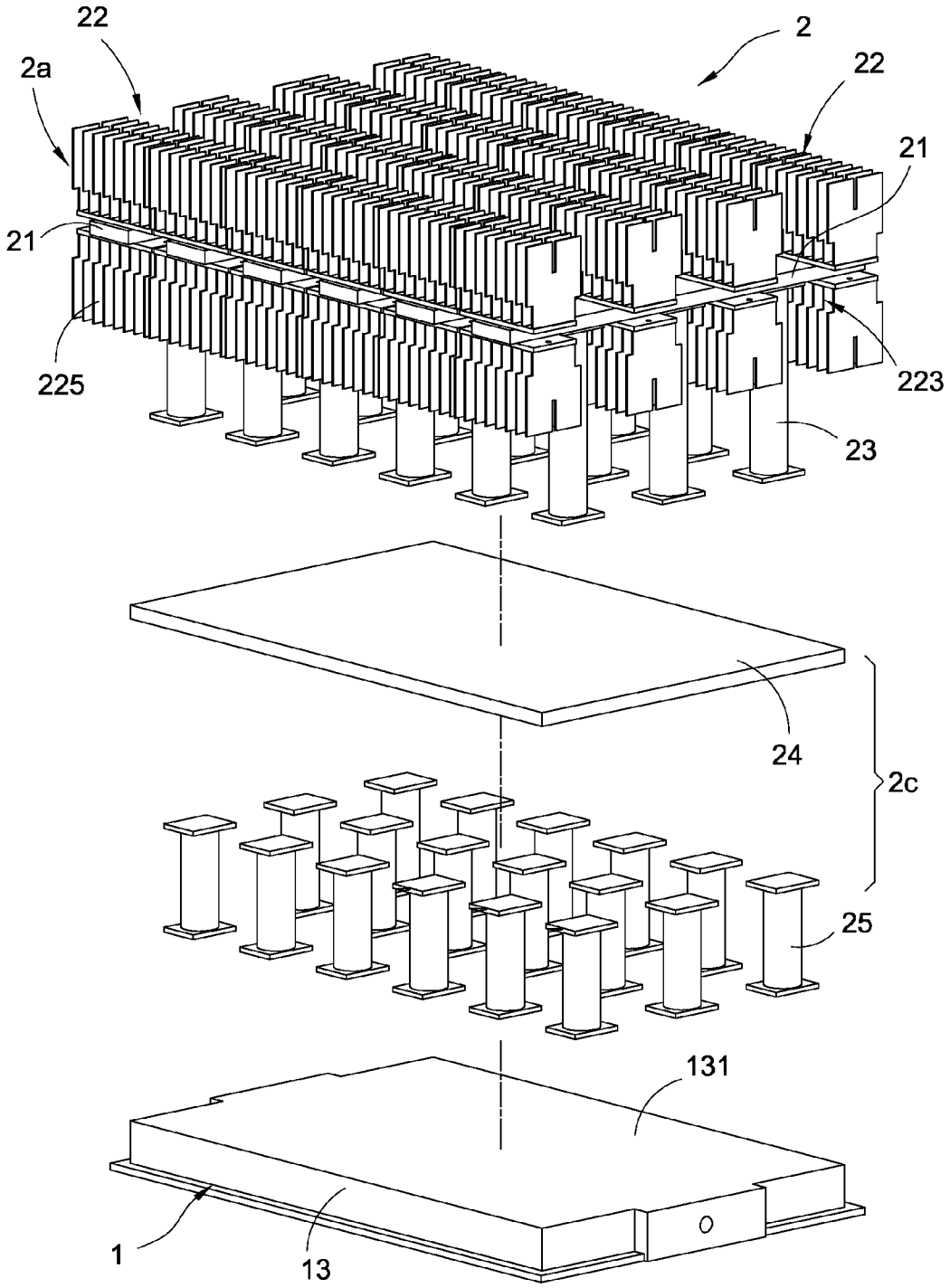
FIG. 5 is an exploded view of the third embodiment of the LED lighting device of the present invention.
Figure 6:
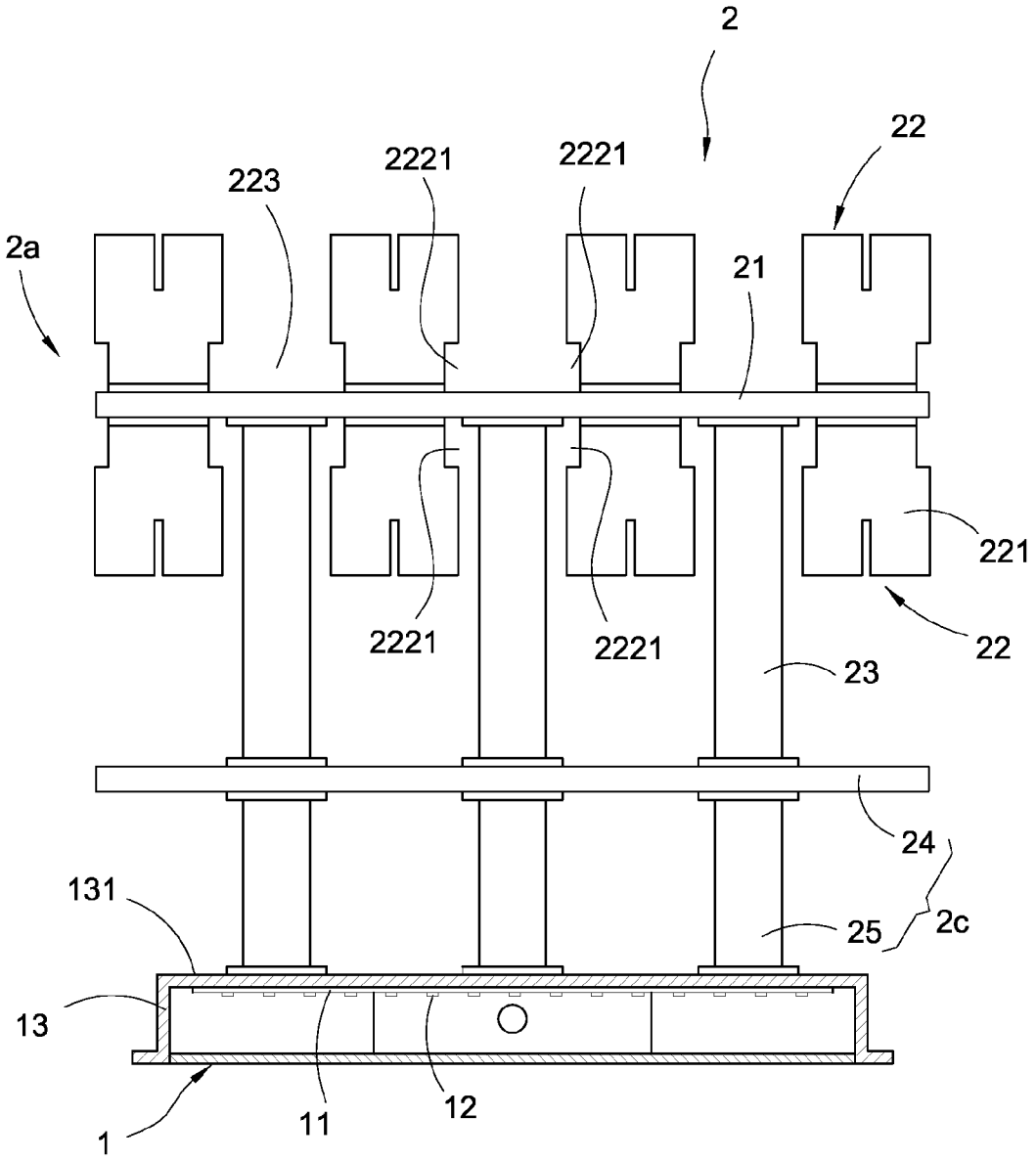
FIG. 6 is a side view of the present invention in FIG. 5.

FIGS. 5 and 6 show a third embodiment of the present invention, which is generally similar to the first embodiment and with the addition of an assistant heat dissipation structure 2C further provided on the heat sink 2. The assistant heat dissipation structure 2C comprises a heat conductive unit 24 and a plurality of assistant vertical heat conductive rods 25; wherein the heat conductive unit 24 can be a thermal plate or a heat spreading plate and is connected between the lower end of the aforementioned plurality of vertical heat conductive rods 23 and the upper end of the plurality of assistant vertical heat conductive rods 25 while the lower end of the plurality of assistant vertical heat conductive rods 25 are vertically connected to the back side 131 of the LED light engine 1 in order to achieved a better effect of heat dissipation. In detail, each one of the vertical heat conductive rods 23 is connected to each one of the assistant vertical heat conductive rods 25; in other words, the lower end of each one of the vertical heat conducive rods 23 is connected to the upper end of each one of the assistant vertical heat conductive rods 25 via the heat conductive unit 24.

Figure 7:
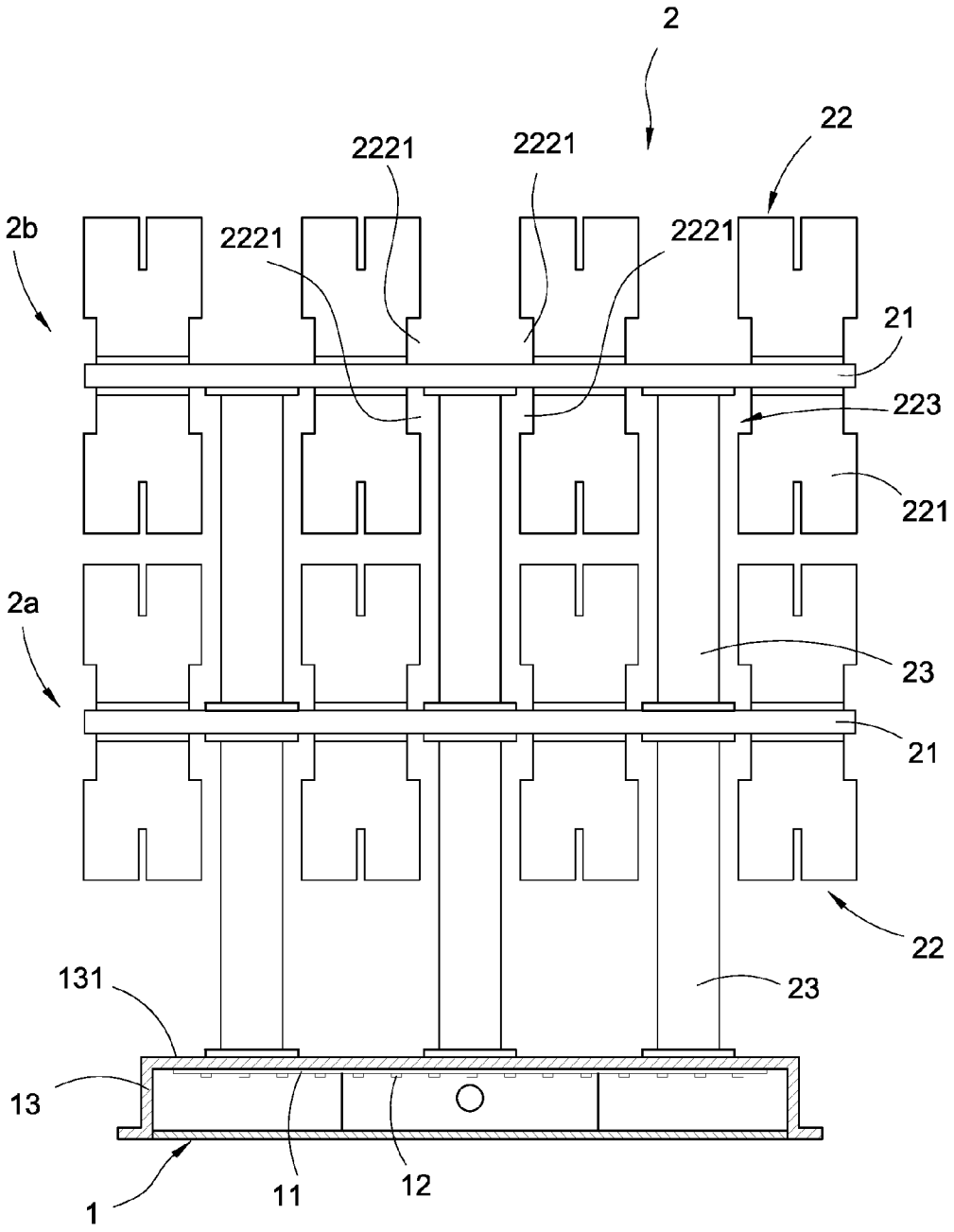
FIG. 7 is a side view of the fourth embodiment of the LED lighting device of the present invention.

FIG. 7 shows a fourth embodiment of the present invention, which is generally similar to the first embodiment and with the addition of at least one layer of another heat dissipation structure 2*b* on top of the original heat dissipation structure 2*a* and the another heat dissipation structure 2*b* is also of a structure similar to that of the aforementioned heat dissipation structure 2*a*. As shown in the figure, the lower end of the plurality of vertical heat conductive rods 23 of each one of the heat conductive rod rows of the another heat dissipation structure 2*b* is attached with the upper surface of each one of the horizontal heat conductive rods 21 of the heat dissipation structure 2*a* in order to achieve the increased effect of heat dissipation efficiency with the layered structures. In detail, the lower end of the plurality of vertical heat conductive rods 23 of the another heat dissipation structure 2*b* is connected to the upper end of the plurality of vertical heat conducive rods 23 of the heat dissipation structure 2*a* via the plurality of horizontal heat conducive rods 21 of the heat dissipation structure 2*a*.

With the increased heat dissipation area and the enhanced effect of heat dissipation, it is applicable to the LED light engine 1 of higher working power (such as 2000~5000 W or even higher than 5000 W). In addition, the heat sink 2 can be stacked on top of another layer by layer with an increasing height (such as a heat dissipation structure of three layers or more), and the present invention is not limited any number of layers.

In view of the above, the present invention includes the following merits over the related arts: in the first to fourth embodiments of the present invention, by utilizing special connection methods and combinations of the vertical heat conductive rods 23 with the horizontal heat conductive rods 21, the heat dissipation area is increased and the heat sink 2 is separated from the LED light engine 1 such that the heat does not accumulate on the LED light engine in order to significantly enhance the effect of heat dissipation as mentioned in the objective. Furthermore, with the air channels 223 and the fin channels 225 fluidly connected to each other and longitudinally and laterally intersecting and cross-linking with each other, in a manner similar to the chessboard, the shortcoming of air unable to reach particular locations of the heat sink (such as the center of the heat sink) can be overcome with improved airflows.

Furthermore, the present invention is of the further merits: by allowing the heat sink 2 to be stacked on top of another layer by layer with an increasing height, the heat dissipation capacity thereof can be further increased and to meet the demands of current LED light engine 1 of increasingly higher powers.

The above provides preferred embodiments of the present invention for illustrative purposes only and shall not be treated as limitations to the scope of the present invention. Any structural modifications of equivalent effects based on the content and drawings of the specification of the present invention shall be deemed to be within the scope of the present invention.

What is claimed is:

1. A heat sink comprising a heat dissipation structure, the heat dissipation structure comprising:

a plurality of heat conductive rod rows, each one of the plurality of heat conductive rod rows comprising a plurality of vertical heat conductive rods;

a plurality of horizontal heat conductive rods, each one of the plurality of horizontal heat conductive rods comprising a plurality of surfaces and attached onto one end of the plurality of vertical heat conductive rods of each one of the plurality of heat conductive rod rows;

a plurality of fin modules, attached to any one of the plurality of surfaces of each one of the plurality of horizontal heat conductive rods; and an assistant heat dissipation structure including a heat conductive unit and a plurality of assistant vertical heat conductive rods, wherein the heat conductive unit is attached between another end of the plurality of vertical heat conductive rods and one end of the plurality of assistant vertical heat conductive rods.

2. The heat sink according to claim 1, wherein the plurality of fin modules are attached to any two corresponding surfaces of the plurality of surfaces of each one of the horizontal heat conductive rods respectively.

3. The heat sink according to claim 2, wherein each one of the plurality of fin modules comprises a plurality of fins spaced apart from each other; a groove is provided on two opposite sides of each one of the plurality of fins respectively; and an air channel is formed by each one of the grooves and between any four of the plurality of fin modules adjacent to each other.

4. The heat sink according to claim 3, wherein the groove of each one of the plurality of fins is a cut-out portion; the cut-out portion is formed between two opposite sides and a bottom of each one of the plurality of fins; the plurality of surfaces of each one of the horizontal heat conductive rods comprise an upper surface and a lower surface; each one of the plurality of fin modules is attached to the upper surface or the lower surface of the horizontal heat conductive rod with the bottom thereof.

5. The heat sink according to claim 1, wherein each one of the vertical heat conductive rods further comprises a plurality of heat dissipation fins mounted thereon.

6. The heat sink according to claim 1, wherein the heat conductive unit is a thermal plate or a heat spreading plate.

7. The heat sink according to claim 1, wherein the another end of each one of the plurality of vertical heat conductive rods is connected to the one end of each one of the plurality of assistant vertical heat conductive rods via the heat conductive unit.

8. The heat sink according to claim 1, further comprising another heat dissipation structure, and the plurality of surfaces of each one of the horizontal heat conductive rods comprise an upper surface and a lower surface; another end of the plurality of vertical heat conductive rods of each one of the heat conductive rod rows of the another heat dissipation structure is attached with an upper surface of each one of the horizontal heat conductive rods of the heat dissipation structure.

9. An LED lighting device, comprising:

an LED light engine; and a heat sink comprising a heat dissipation structure; the heat dissipation structure comprising:

a plurality of heat conductive rod rows, each one of the plurality of heat conductive rod rows comprising a plurality of vertical heat conductive rods;

a plurality of horizontal heat conductive rods, each one of the plurality of horizontal heat conductive rods comprising a plurality of surfaces attached onto one end of the plurality of vertical heat conductive rods of each one of the plurality of heat conductive rod rows; another end of the plurality of vertical heat conductive rods of each one of the plurality of heat conductive rod rows vertically attached to a back side of the LED light engine;

a plurality of fin modules, attached to any one of the plurality of surfaces of each one of the plurality of horizontal heat conductive rods; and an assistant heat dissipation structure including a heat conductive unit and a plurality of assistant vertical heat conductive rods, wherein the heat conductive unit is connected between another end of the plurality of vertical heat conductive rods and one end of the plurality of assistant vertical heat conductive rods; another end of the plurality of assistant vertical heat conductive rods is vertically attached to the back side of the LED light engine.

10. The LED lighting device according to claim 9, wherein the plurality of fin modules are attached to any two corresponding surfaces of the plurality of surfaces of each one of the plurality of horizontal heat conductive rods.

11. The LED lighting device according to claim 10, wherein each one of the plurality of fin modules comprises a plurality of fins spaced apart from each other; a groove is provided on two opposite sides of each one of the plurality of fins respectively; and an air channel is formed by each one of the grooves and between any four of the plurality of fin modules adjacent to each other.

12. The LED lighting device according to claim 11, wherein the groove of each one of the plurality of fins is a cut-out portion; the cut-out portion is formed between two opposite sides and a bottom of each one of the plurality of fins; the plurality of surfaces of each one of the horizontal heat conductive rods comprise an upper surface and a lower surface; each one of the plurality of fin modules is attached to the upper surface or the lower surface of the horizontal heat conductive rod with the bottom thereof.

13. The LED lighting device according to claim 9, wherein each one of the vertical heat conductive rods further comprises a plurality of heat dissipation fins mounted thereon.

14. The LED lighting device according to claim 9, wherein the heat conductive unit is a thermal plate or a heat spreading plate.

15. The LED lighting device according to claim 9, wherein the another end of each one of the plurality of vertical heat conductive rods is connected to the one end of each one of the plurality of assistant vertical heat conductive rods via the heat conductive unit.

16. The LED lighting device according to claim 9, further comprising another heat dissipation structure, and the plurality of surfaces of each one of the horizontal heat conductive rods comprise an upper surface and a lower surface; another end of the plurality of vertical heat conductive rods of each one of the heat conductive rod rows of the another heat dissipation structure is attached with an upper surface of each one of the horizontal heat conductive rods of the heat dissipation structure.

17. The LED lighting device according to claim 16, wherein another end of the plurality of vertical heat conductive rods of the another heat dissipation structure is connected to one end of the plurality of vertical heat conductive rods of the heat dissipation structure via the plurality of horizontal heat conductive rods of the heat dissipation structure.

18. The LED lighting device according to claim 9, wherein the LED light engine further comprises a circuit board; a plurality of LED units are electrically connected on the circuit board; another end of the plurality of vertical heat conductive rods of each one of the plurality of heat conductive rod rows is directly attached to a back side of the circuit board.

19. The LED lighting device according to claim 9, wherein the LED light engine further comprises a light housing and a circuit board having a plurality of LED units electrically connected thereto; the circuit board is flatly attached to a front side of the light housing; another end of the plurality of vertical heat conductive rods of each one of the heat conductive rod rows is attached to a back side of the light housing.

20. The LED lighting device according to claim 9, wherein the heat sink further comprises a plurality of heat dissipaters; each one of the heat dissipaters is attached to the back side of the LED light engine.

* * * * *